US011217418B2

(12) United States Patent
Andrews et al.

(10) Patent No.: US 11,217,418 B2
(45) Date of Patent: Jan. 4, 2022

(54) ELECTRICAL ARRANGEMENTS WITH SEALED HOUSING CONTAINING ELECTRICALLY INSULATING FLUID AND TEMPERATURE COMPENSATION BLADDER

(71) Applicant: Teledyne UK Limited, Chelmsford (GB)

(72) Inventors: Stuart William Andrews, Colchester (GB); Thomas Samuel Christopher, Colchester (GB); Daniel James Clay, Essex (GB)

(73) Assignee: TELEDYNE UK LIMITED, Chelmsford (GB)

( * ) Notice: Subject to any disclaimer, the term of this patent is extended or adjusted under 35 U.S.C. 154(b) by 0 days.

(21) Appl. No.: 16/905,224

(22) Filed: Jun. 18, 2020

(65) Prior Publication Data

US 2021/0305000 A1 Sep. 30, 2021

(30) Foreign Application Priority Data

Mar. 27, 2020 (GB) ..... 2004537

(51) Int. Cl.
*H01J 25/58* (2006.01)

(52) U.S. Cl.
CPC ..... *H01J 25/58* (2013.01)

(58) Field of Classification Search
CPC ..... H01J 25/58
See application file for complete search history.

(56) References Cited

U.S. PATENT DOCUMENTS 2,885,582 A 5/1959 Bell

FOREIGN PATENT DOCUMENTS

CN 203733750 U 7/2014

*Primary Examiner* — Joseph L Williams
(74) *Attorney, Agent, or Firm* — FisherBroyles, LLP; Robert Kinberg

(57) ABSTRACT

An electrical arrangement, which may, for example be a magnetron, has a sealed chamber and electrically insulating fluid contained within the chamber. A temperature expansion compensation bladder comprising a helical tube is located within the chamber, the helical tube having an end open to ambient atmosphere outside the chamber, and having a closed end within the chamber.

18 Claims, 7 Drawing Sheets

ELECTRICAL ARRANGEMENTS WITH SEALED HOUSING CONTAINING ELECTRICALLY INSULATING FLUID AND TEMPERATURE COMPENSATION BLADDER

CROSS-REFERENCE TO RELATED APPLICATIONS

This application claims priority to Great Britain Patent Application No. 2004537.3 filed Mar. 27, 2020, the entire contents of which are incorporated herein by reference.

FIELD OF THE INVENTION

This invention relates to electrical arrangements, and more particularly, but not exclusively, to magnetrons.

BACKGROUND

It is sometimes necessary to use insulating fluid around high voltage assemblies to prevent electrical breakdown. The insulating fluid is contained within a sealed housing. However, this can cause issues when higher temperatures are encountered as the fluid expands and may damage the housing.

SUMMARY

According to a first aspect of the invention, an electrical arrangement comprises: a sealed chamber; electrically insulating fluid contained within the chamber; a temperature expansion compensation bladder comprising a helical tube located within the chamber, the helical tube having an end open to ambient atmosphere outside the chamber and having a closed end within the chamber.

As the temperature increases, the volume of the insulating fluid increases and the helical tube contracts, compensating for the change and preventing excess pressure within the sealed chamber. The helical shape of the tube is particularly advantageous as it allows a region within the tube to be occupied by other components of the electrical arrangement and it also presents a relatively large surface area for the pressure to act on.

By employing the invention, the electrical arrangement is able to withstand much greater environmental temperatures during shipping and storage, and also any additional heating caused when the arrangement is operative. The configuration of the helical tube allows it to be added to an existing design of an electrical arrangement without requiring a change in the form or outline of the electrical arrangement to accommodate it. The present invention avoids excessive pressure inside the sealed, fluid-filled, chamber caused by the volume of fluid changing over a temperature range.

According to a second aspect of the invention, a magnetron comprises: a sealed chamber; electrically insulating fluid contained within the chamber; a temperature expansion compensation bladder comprising a helical tube located within the chamber, the helical tube having an end open to ambient atmosphere outside the chamber and having a closed end within the chamber. The invention is particularly useful as it allows expansion to be accommodated without having to change the outer configuration of the magnetron. As magnetrons are often used in restricted spaces, for example, in radiotherapy machines, this is an advantageous aspect of the use of the helical tube. Also, the volume of insulating fluid may change significantly over the temperature range required for storage, transportation and operation. Use of the invention allows the magnetron to be used, stored or transported in conditions which would otherwise cause damage to it.

The magnetron may comprise: a magnetron cathode; an electrical connector for connection to an external power source; a sidearm located within the chamber, the sidearm including an elongate envelope having a longitudinal axis and containing connections to the magnetron cathode; and high voltage leads connected between the sidearm and the electrical connector, the helical tube being located at least partially around the high voltage leads and extensive in the direction of the longitudinal axis of the sidearm.

In one embodiment of the invention, the ambient atmosphere is air. In another embodiment, the ambient atmosphere is another gas contained within a room or housing within which the magnetron is located.

In one embodiment of the invention, the electrically insulating fluid is a liquid. This could be a mineral oil, a synthetic oil such as silicone oils, or some other suitable dielectric liquid. In another embodiment, the electrically insulating fluid is a gas. The fluid is chosen to have voltage hold-off characteristics suitable for the voltages involved.

In one embodiment, the magnetron is at least one of stored, transported and operated in an ambient temperature in the range −40 Celsius to +90 Celsius. In one embodiment, the range is −25 Celsius to +70 Celsius. High temperatures might be encountered, for example, when the magnetron is stored within an uncooled building in a high temperature outside environment. Use of the invention mitigates the effects of the high temperatures.

In one embodiment, a support structure is included for holding the helical tube in position, the support structure allowing movement of the tube as it expands and contracts with changing temperature.

In one embodiment, the support structure includes a plurality of support rods extensive in a longitudinal axial direction and a mechanical fixing arrangement to fix the tube to the plurality of support rods. In one embodiment, the support rods are of non-electrically conductive material. The mechanical fixing arrangement, may, for example, comprise support cables.

In one embodiment, the support structure is a cylindrical member located between the tube and high voltage leads supplying the magnetron cathode.

In one embodiment, the cylinder is of electrically conductive material and is at ground during operation, the wall of the sealed chamber being electrically conductive and at ground during operation. Thus, this arrangement removes the electrical field across the tube, preventing breakdown of the air or other medium within the tube.

In one embodiment, there is an electrical field across the helical tube during operation of the magnetron.

In one embodiment, the magnetron is operable such that the cathode potential is maintained in the range −20 kV to −120 kV and the anode is at ground.

In one embodiment, the wall of the sealed chamber is electrically conductive and at ground during operation of the magnetron.

According to a second aspect of the invention, a modulator system comprises: a sealed chamber; electrically insulating fluid contained within the chamber; a temperature expansion compensation bladder comprising a helical tube located within the chamber, the helical tube having an end open to ambient atmosphere outside the chamber and having a closed end within the chamber. In one embodiment, the modulator system includes a cylindrical structure within the space bounded by the helical tube and coaxial with the helical tube to provide electrical shielding.

DESCRIPTION OF THE DRAWINGS

Some embodiments of the present invention will now be described by of example only, and with reference to the accompanying drawings, in which.

DETAILED DESCRIPTION

Figure 1:
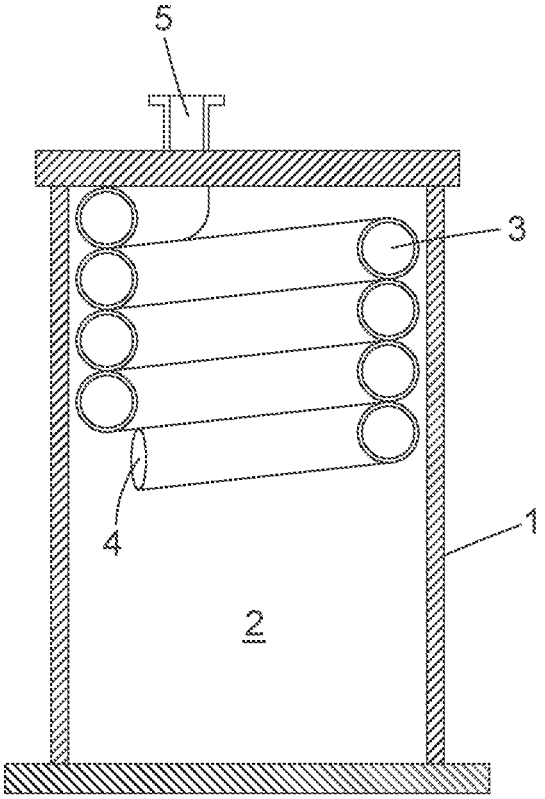
FIG. 1 schematically illustrates an expansion compensation arrangement in accordance with the invention.

With reference to FIG. 1, an electrical arrangement includes a sealed chamber 1 having a cylindrical wall within which is included a dielectric fluid 2, which, in this example, is a mineral oil. The specific insulating fluid that is used is chosen to reduce or prevent electrical breakdown between components (not shown) at different electrical potentials housed within the chamber, which also may be electrically conducting. As the chamber 1 is sealed, an increase in temperature could lead to the pressure of the insulating fluid increasing to such an extent that it damages the chamber, possibly fracturing it, and components housed within it.

A helical tube 3 is located within the chamber. It is formed from a material which is impervious to the insulating fluid and is capable of expanding and contracting. A plastics material may be suitable for the tube 3. The tube 3 has a sealed end 4 within the chamber 1 and an open end 5 which passes through, and is hermetically sealed to, the chamber wall and is open to ambient atmosphere, which typically is air.

When the temperature increase, which may be due to changes in the external environment and/or temperature increases during operation of the electrical arrangement, the insulating fluid 2 expands. The tube 3 contracts, allowing the fluid to take up a greater volume within the chamber and releasing any build-up of pressure which would otherwise occur. As the temperature drops, the volume of the oil reduces and the tube expands accordingly.

Figure 2:
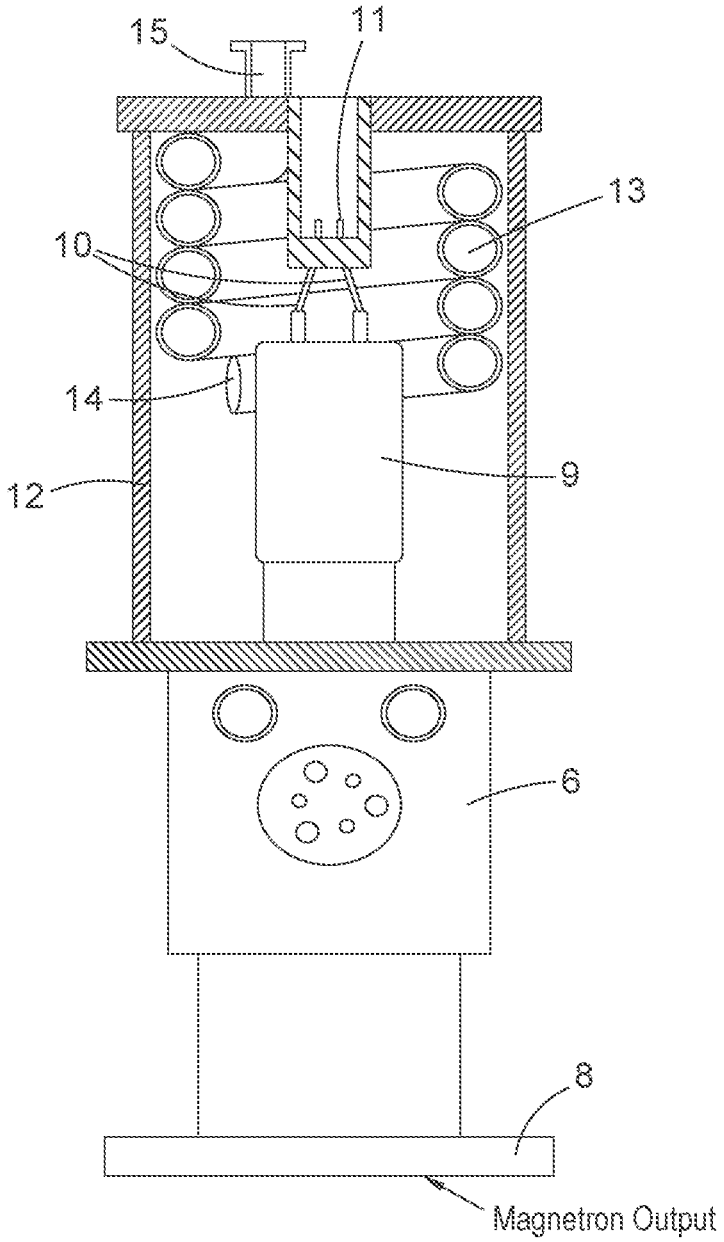
FIG. 2 schematically illustrates in partial cross section a magnetron in accordance with the invention.
Figure 3:
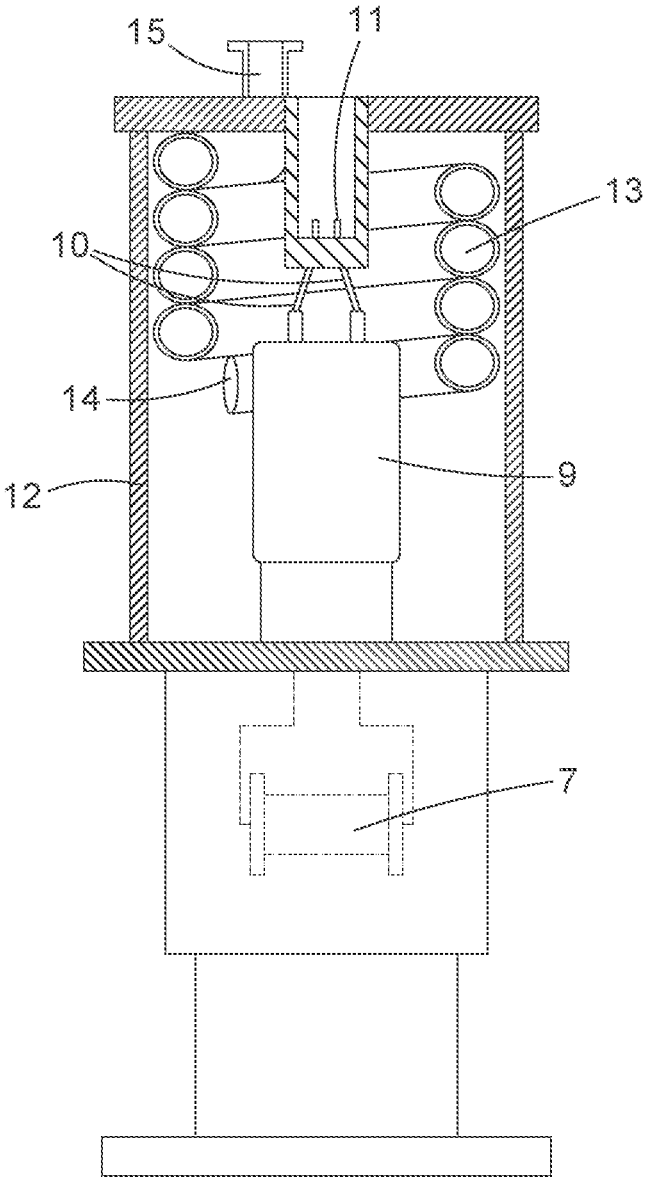
FIG. 3 schematically illustrates the magnetron of FIG. 2 including the magnetron cathode.

With reference to FIGS. 2 and 3, a magnetron includes an anode 6 and a cathode 7, with an output 8 for extracting the generated energy. The electrical connections to the cathode 7 are housed within an envelope, which is often termed a sidearm 9. High voltage (HV) leads 10 electrically connect the cathode 7 to an external connector 11.

The sidearm 9 is housed within a sealed chamber 12 which is shown in cross section. The chamber 12 is of an electrically conductive material and maintained at ground during operation. The HV leads 10 are at a potential in the range −20 kV to −120 kV. The chamber is filled with a dielectric material to prevent breakdown between the HV leads 10 and the wall of the chamber 12.

A helical tube 13 is contained within the chamber 12 and surrounds the HV leads 10 and external connector 11. The tube 13 has a sealed end 14 within the chamber and an open end 15 which is open to the ambient atmosphere, typically air.

Figure 4:
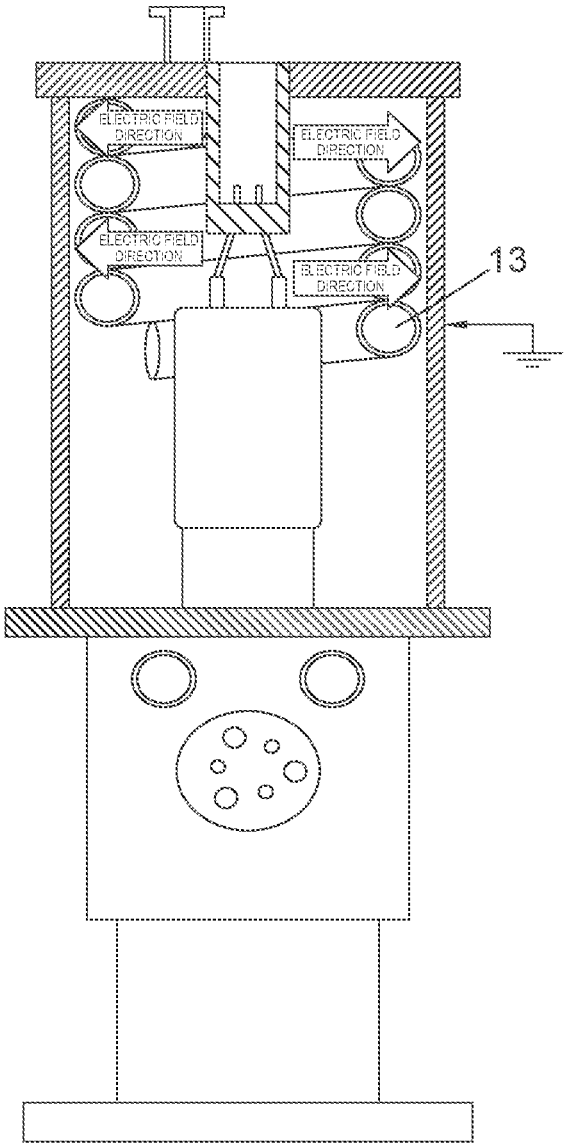
FIG. 4 schematically illustrates operation of the magnetron of FIGS. 2 and 3.

FIG. 4 shows the direction of the electrical filed within the chamber 12 and the field within the tube. The tube dimensions and material are selected such that at the operating voltages and the dimensions and spacings of the components and walls cause no ionisation of air within the tube 13. In this embodiment, the field within the tube 13 is kept at less than 2 kV/mm to avoid ionisation of the air within the tube 13.

As the temperature increases, the dielectric fluid expands and the tube 13 contracts to compensate for the increased volume required by the dielectric fluid.

Figure 5:
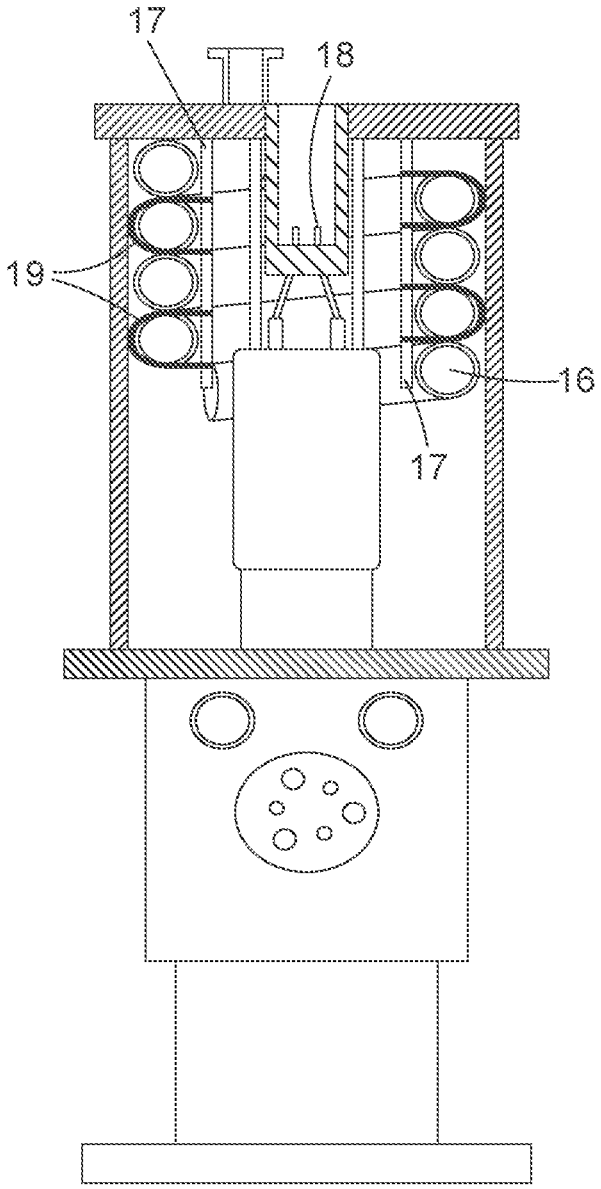
FIG. 5 schematically illustrates a magnetron including a support.

With reference to FIG. 5, a magnetron similar to that described with reference to FIGS. 2 and 3 includes a support structure for the helical tube 16. This holds the tube in position but still permits expansion and contraction of the tube 16. A plurality of dielectric rods 17 are disposed in a longitudinal axial direction and surround the external connector 18. The tube 16 is attached to the rods 17 by cables 19.

Figure 6:
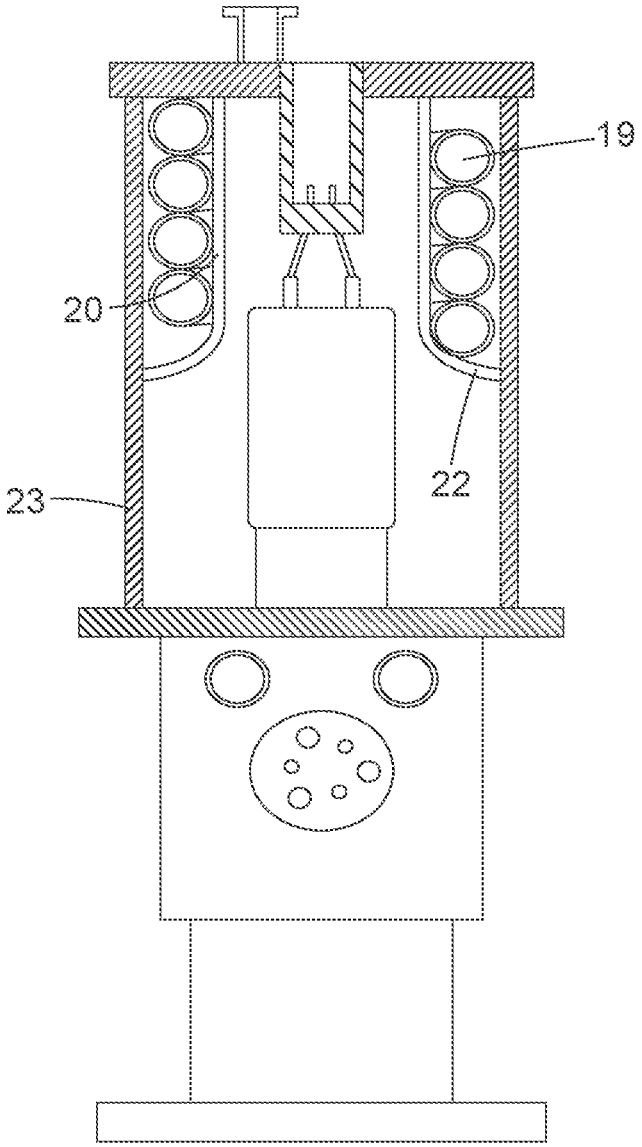
FIG. 6 schematically illustrates a magnetron including another form of support.

With reference to FIG. 6, another magnetron is similar to the magnetron shown in FIGS. 2 and 3 but in this case, a cylindrical support 20 is provided for the helical tube 21. The cylindrical support is flared at one end 22 to define a closed volume within which the tube is constrained. In this embodiment, the cylindrical support 20 is of electrically conductive material and is secured to the walls of the sealed chamber 23.

During operation, the chamber 23 is held at ground as is the cylindrical support 20 as it is in electrical contact with the chamber wall. The arrangement ensures that there is no electrical field within the part of the chamber occupied by the tube 19 and thus ionisation of the air within the tube is not a concern.

Figure 7A:
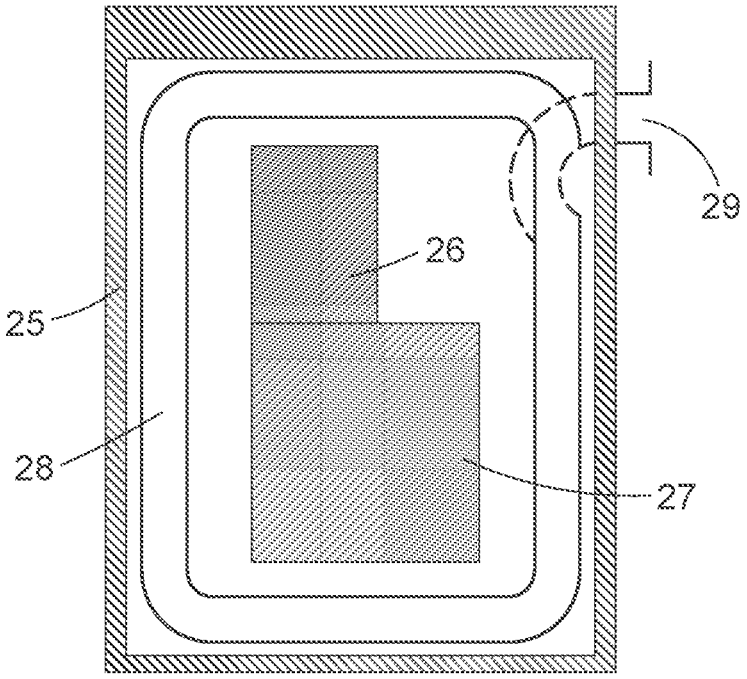
FIG. 7*a* and FIG. 7*b* schematically illustrate a modulator in accordance with the invention.
Figure 7B:
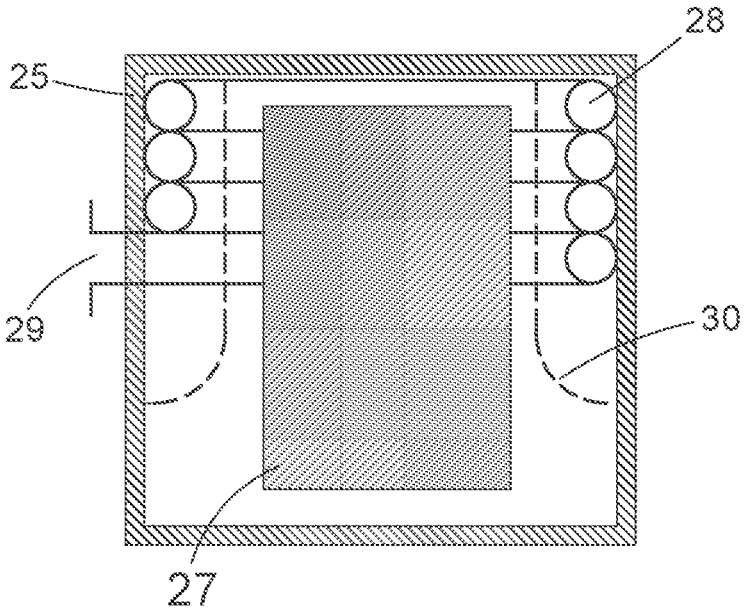

With reference to FIGS. 7*a* and 7*b*, a modulator 24 comprises an outer housing 25 which is a sealed, fluid-filled enclosure and contains modulator electrical components shown schematically at 26 and 27. A helical tube 28 surrounds the electrical components and has a single open end shown at 29.

An optional cylindrical screen 30 shown in FIG. 7*b* is located in the volume bounded by the helical tube and is electrically and physically connected to the housing 25 to provide electrical shielding.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The invention claimed is:

1. An electrical arrangement comprising: a sealed chamber; electrically insulating fluid contained within the chamber; a temperature expansion compensation bladder comprising a helical tube located within the chamber, the helical tube having an end open to ambient atmosphere outside the chamber and having a closed end within the chamber.

2. A magnetron comprising: a sealed chamber; electrically insulating fluid contained within the chamber; a temperature expansion compensation bladder comprising a helical tube located within the chamber, the helical tube having an end open to ambient atmosphere outside the chamber and having a closed end within the chamber.

3. The magnetron of claim 2 and comprising: a magnetron cathode; an electrical connector for connection to an external power source; a sidearm located within the chamber, the sidearm including an elongate envelope having a longitudinal axis and containing connections to the magnetron cathode; and high voltage leads connected between the sidearm and the electrical connector, the helical tube being located at least partially around the high voltage leads and extensive in the direction of the longitudinal axis of the sidearm.

4. The magnetron as claimed in claim 2 wherein the ambient atmosphere is air.

5. The magnetron as claimed in claim 2 wherein the electrically insulating fluid is a liquid.

6. The magnetron as claimed in claim 2 wherein the magnetron is at least one of: stored, transported and operated in an ambient temperature in the range −40 Celsius to +90 Celsius.

7. The magnetron as claimed in claim 6 wherein the magnetron is at least one of: stored, transported and operated in an ambient temperature in the range −25 Celsius to +70 Celsius.

8. The magnetron as claimed in claim 2 and including a support structure for holding the helical tube in position, the support structure allowing movement of the tube as it expands and contracts with changing temperature.

9. The magnetron as claimed in claim 8 wherein the support structure includes a plurality of support rods extensive in a longitudinal axial direction and a mechanical fixing arrangement to fix the tube to the plurality of support rods.

10. The magnetron as claimed in claim 9 wherein the support rods are of non-electrically conductive material.

11. The magnetron as claimed in claim 9 wherein the mechanical fixing arrangement comprises support cables.

12. The magnetron as claimed in claim 8 wherein the support structure is a cylindrical member located between the tube and high voltage leads supplying the magnetron cathode.

13. The magnetron as claimed in claim 12 wherein the cylinder is of electrically conductive material and is at ground during operation, the wall of the sealed chamber being electrically conductive and at ground during operation.

14. The magnetron as claimed in claim 2 and there being an electrical field across the helical tube during operation of the magnetron.

15. The magnetron as claimed in claim 2 and operable such that the cathode potential is maintained in the range −20 kV to −120 kV and the anode is at ground.

16. The magnetron as claimed in claim 2 wherein the wall of the sealed chamber is electrically conductive and at ground during operation of the magnetron.

17. A modulator system comprising: a sealed chamber; electrically insulating fluid contained within the chamber; a temperature expansion compensation bladder comprising a helical tube located within the chamber, the helical tube having an end open to ambient atmosphere outside the chamber and having a closed end within the chamber.

18. The modulator system of claim 17 and including a cylindrical structure within the space bounded by the helical tube and coaxial with the helical tube to provide electrical shielding.

* * * * *